United States Patent [19]

Nicholas

[11] Patent Number: 4,616,460

[45] Date of Patent: Oct. 14, 1986

[54] ELASTOMERIC GLANDS

[75] Inventor: John D. Nicholas, Tucker, Ga.

[73] Assignee: MM Systems Corporation, Tucker, Ga.

[21] Appl. No.: 804,046

[22] Filed: Dec. 3, 1985

[51] Int. Cl.[4] ..... E01C 11/10; F16J 15/10

[52] U.S. Cl. ..... 52/396; 52/403; 277/205; 277/207 R; 277/237 R; 404/64

[58] Field of Search ..... 404/64, 65; 405/135, 405/147; 52/396, 403; 277/12, 205, 207 R, 237 R

[56] References Cited

U.S. PATENT DOCUMENTS

| | | | |
|---|---|---|---|
| 3,358,568 | 12/1967 | Brown | 404/65 |
| 3,606,826 | 9/1971 | Bowman | 404/64 X |
| 3,762,826 | 10/1973 | Bowman | 404/64 |
| 3,776,654 | 12/1973 | Brown | 404/65 |
| 3,778,176 | 12/1973 | Pax | 404/65 |
| 3,960,462 | 6/1976 | Kerschner | 404/64 |
| 4,522,413 | 6/1985 | Nicholas | 404/64 X |

*Primary Examiner*—Allan N. Shoap
*Attorney, Agent, or Firm*—John B. Armentrout

[57] ABSTRACT

Longitudinally multi-tubular elastomeric glands, and in certain embodiments elastomeric gland and mount systems, are provided for the gland or system to be combined with relatively movable bodies to close off a movement tolerance space between the bodies, the gland being characterized longitudinally laterally centrally by including in the structure thereof a generally octagonal wall member wherein a pair of forward and rearward side walls of the octagonal wall member produce an I-beam aspect with an intermediate strut wall of the gland, inside the octagonal wall member, having the intermediate strut wall flanked on opposite sides thereof by another pair of side walls of the octagonal wall member and by structure in the gland for supporting the octagonal wall member at the latter two side walls and transmitting and relieving thrust against the octagonal wall member as prescribed by the relative movement of the bodies.

18 Claims, 3 Drawing Figures

FIG. 1
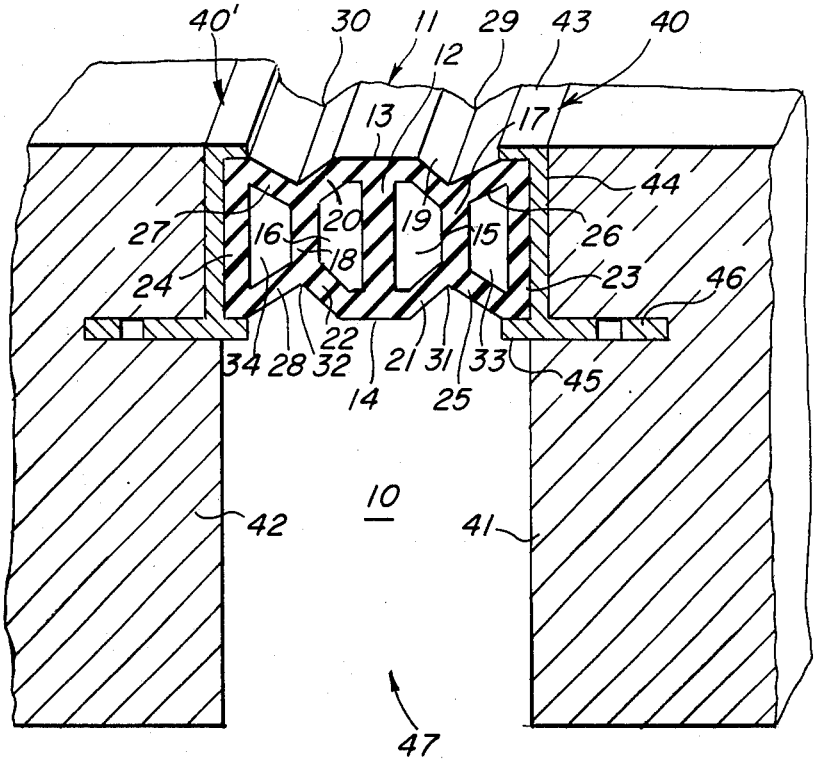
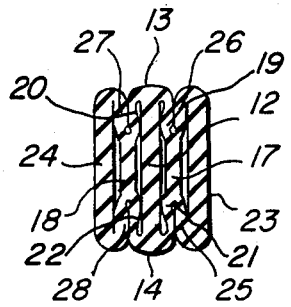
FIG. 2
FIG. 3
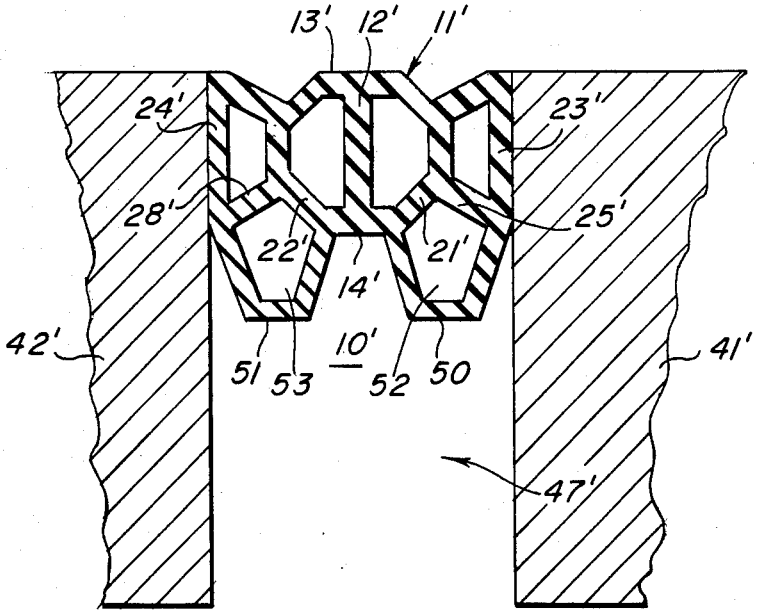

ELASTOMERIC GLANDS

The present invention relates to elastomeric glands for use in association with relatively movable bodies to close off a movement tolerance space between those bodies and yet allow relative movement of those bodies and, further the invention relates to installations including elastomeric glands and to systems wherein gland and mount structure is provided.

An object of this invention is to provide elastomeric glands which are practical for production and in use and are well suited for the gland to operate within a movement tolerance space between relatively movable bodies thus to close off the movement tolerance space and still allow relative movement of the bodies.

Another object herein is the provision of elastomeric glands of the character indicated wherein the gland includes self-bracing truss structure, for bridging across the movement tolerance space between relatively movable bodies and nevertheless accomplishing highly satisfactory elastomeric folding and unfolding actions respectively when compressed and relaxed from opposite lateral ends of the gland.

A further object of this invention is that of providing an elastomeric gland of the character indicated wherein the gland centrally between opposite lateral ends of the gland includes an I-beam feature of bracing which is appreciably maintained in the truss structure of the gland throughout the side to side compression and relaxation range of the gland.

Another object herein is the provision of elastomeric glands of the character indicated which resist being distended at the outer face of the gland when the gland is presented between relatively movable bodies and is laterally being compressed from the opposite lateral ends throughout the compression and relaxation range of the gland.

Other objects of this invention in part will be obvious and in part pointed out more fully hereinafter.

As conducive to a clearer understanding of certain features of this invention, it is noted at this point that elastomeric glands are in widespread demand for use as expansion joint components or, more generally, as components having utility between relatively movable bodies. Some of these demands arise within the highway paving or sidewalk paving arts wherein sections of a pavement, such as of concrete, are produced with spaces between the sections, thus allowing relative movement of the sections to occur due primarily to expansion and contraction from temperature changes while the sections are in place. The spaces between the sections accordingly offer protection against having the sections meet endwise and thereafter compress to the point of failure from overload. Elastomeric glands are installed within the movement tolerance spaces between the sections in order to follow the relative movement of the sections and afford continuity between the sections while covering the movement tolerance spaces.

Other uses for elastomeric glands illustratively apply to floors of bridges which are constructed to carry vehicular traffic, with sections of the bridge floor being spaced apart having elastomeric glands therebetween to complete the joints and protect the sections from directly meeting one against the other because of thermally expanding or being subjected to vibrations. Further, in suoh structures as floors, walls, ceilings, roofs, or the like, of buildings, it often becomes important to add elastomeric glands between sections or panels, or in corner locations such as at wall to wall junctions, floor to wall junctions or ceiling to wall junctions to account for thermal expansion or contraction and sometimes also to protect against damage from earth tremors or other vibrational hazards.

The foregoing will serve to identify by way of example only a few instances where elastomeric glands are needed to co-act with relatively movable bodies. Should the elastomeric glands be ones which are to be exposed outdoors, valleys in the outer face of the gland, when upwardly faced, are beneficial for carrying off water in addition to whatever the valleys may contribute for enabling the gland to fold and unfold when being compressed and relieved. Ridge structure, when offered between valleys at the outer face of the gland, also can be beneficial such as for adding frontal surface area between the relatively movable bodies while the gland covers and thus shields the movement tolerance space, and in instances where the gland is installed having the ridge structure upwardly faced near the outside of the movement tolerance space between relatively movable bodies in a pavement or the like, the ridge structure becomes a land to be encountered by foot or wheel traffic.

Many forms of heretofore known elastomeric glands are not well suited for use within a movement tolerance space between relatively movable bodies. A longitudinally multitubular truss-like gland for the latter purpose can of course be to advantage, but many types of glands from the prior art, though longitudinally hollow in structure, have transverse cross sectional configurations which demonstrate poor truss behavior while the gland is being altered in width within a movement tolerance space between relatively movable bodies. Other truss structures provided by longitudinally hollow tubular glands heretofore known have to be ruled out because of being far too complex to satisfy simplicity and, at best, glands of the latter types lead to added cost of production.

A further object of this invention accordingly is to achieve longitudinally multi-tubular elastomeric glands providing truss structure that is well regulated to be simple in configuration and yet affords valley and ridge aspects frontally and is satisfactorily braced within itself, and is enabled to operate in an orderly fashion of folding and unfolding elastically over a favorably long compression and relaxation range, and becomes highly compact as the result of orderly folding when reaching the compression end of the permissible folding and unfolding range under conditions of meanwhile offering restraint against being distended at outer face.

In accordance with practice of the present invention, longitudinally multi-tubular elastomeric glands are provided for the gland to operate inside a movement tolerance space between relatively movable bodies. A generally octagonal wall member which is tubular longitudinally of the gland is subdivided interiorily by an intermediate strut wall of the gland which interconnects a first pair of side walls of the octagonal wall member, while having junctions with the first pair of side walls medially of the first pair of side walls, to provide an I-beam aspect in conjunction with the latter two side walls when the gland is fully relaxed. A second pair of side walls of the octagonal wall member are spaced oppositely of the intermediate strut wall from opposite sides of the intermediate strut wall, and opposite lateral ends of the first and second pairs of side walls are interconnected by third and fourth pairs of side walls of the octagonal wall member. All eight of the side walls of the octagonal wall member form about equal obtuse angles with one another, for the octagonal wall member accordingly to be regular in octagonal configuration, having the first, second, third and fourth pairs of side walls about equal in width to one another within the pairs, such as with all four of the side walls in the third and fourth pairs being about the same in width while having that width differ moderately from the width of the side walls in either or both of the first and second pairs. In certain embodiments in accordance with this invention, the obtuse angles between all of the side walls of the octagonal wall member are about equal, along with all of the side walls of the octagonal wall member being about equal in width.

Side end and slanted connecting structure of the gland includes opposite side end means to be against the relatively movable bodies when the gland is inside the movement tolerance space, and two pairs of slanted intermediate connecting walls interconnecting the second pair of side walls of the octagonal wall member and the opposite side end means. The slanted intermediate connecting walls are spaced outwardly apart from one another in the pairs thereof a progressively increased distance leading from the octagonal wall member, and preferably are connected with the opposite lateral ends of the second pair of side walls of the octagonal wall member, for supporting the octagonal wall member and transmitting thrust to move the second pair of side walls of the octagonal wall toward the intermediate strut wall inside the octagonal wall member. As this movement progresses, the third and fourth pairs of side walls of the octagonal wall member flex reaching from the first pair of side walls of the octagonal wall member, so that when the octagonal wall member is fully compressed the third and fourth pairs of side walls of the octagonal wall member will be in contact with the intermediate strut wall, having the second pair of side walls of the octagonal wall member also be in contact with the intermediate strut wall. Under these conditions, the I-beam aspect provided by the intermediate strut wall of the gland in conjunction with the first pair of side walls of the octagonal wall member still is appreciably present, as will be understood more fully from disclosure herein which is to ensue.

Multi-tubular elastomeric glands in accordance with the present invention are installed between relatively movable bodies for the gland to close off or seal closed a movement tolerance space between the bodies, and in such circumstances as where the bodies are subject to temperature change and the bodies thus expand and contract, or when for example the bodies are caused relatively to move due to vibrations from impact or earth tremors, the gland serves to cover the movement tolerance space while the bodies remain out of contact with one another. The glands are adapted to receive thrust at their opposite lateral ends so as to be narrowed under compression while pressing against the relatively movable bodies and the glands elastically widen when the movement tolerance space becomes wider, and can serve, as need may be, to deflect and resume initial position in response to intermittent load application to the outer face of the gland.

In certain practices in accordance with this invention, discrete mounts, such as of metal, are provided in system with the gland, for the mounts to be affixed to the relatively movable bodies and thus be components of the bodies to carry the gland. An adhesive or other suitable anchoring means may of course be employed for fastening the gland to the mounts or directly to the relatively movable bodies when mounts are omitted. In other instances, the opposite lateral ends of the gland are modified such as to be embedded in the relatively movable bodies or engaged with anchor receptacle structure of the mounts. By installing the gland partially compressed initially the glands produce reactive thrust against the mounts or directly against the relatively movable bodies and sometimes this alone is found to be sufficient for maintaining the glands in situ.

The generally octagonal and intermediate strut wall elastomeric gland structure hereinbefore described as being supplemented by side end and slanted connecting structure lends itself to being further supplemented in accordance with this invention by having loop wall means interconnect the opposite lateral ends of the rearward one of the first pair of side walls of the octagonal wall member with rearward lateral ends of the opposite lateral end means of the gland, thus to have the gland be further plurally tubular and further self-bracing. An illustrative embodiment relating to glands in the latter category will hereinafter be described.

In the accompanying drawings representing embodiments of this invention which presently are preferred:

FIG. 1 is a transverse cross sectional view of an elastomeric gland installed with mounting means on relatively movable bodies, and the view is isometrically prolonged to represent a brief portion of the installation reaching longitudinally of the gland;

FIG. 2 is a transverse cross sectional view applying solely to the gland in FIG. 1 and representing the gland when the latter is in about a fully compressed condition side to side; and FIG. 3 is a transverse cross sectional representation of a further elastomeric gland and installation provided in accordance with this invention.

An elastomeric gland 10 according to the FIG. 1 embodiment is represented as being in a fully relaxed condition to facilitate an understanding of the cross sectional configuration of the gland in that condition. Actually, the gland when first installed would likely be partially compressed within its compression and relaxation range, thus to account for expectations that the movement tolerance space receiving the gland will eventually narrow and widen beyond the initially reduced width of the gland.

Gland 10 is for example a product of extrusion, and is characterized by laterally centrally having a generally octagonal wall member 11 and further the gland has an intermediate strut wall 12 which interconnects a first pair of side walls 13 and 14 of the octagonal wall member 11 medially of the side walls 13 and 14 and defines two generally hexagonal longitudinal passageways 15 and 16 through gland 10, with the octagonal wall member, inside the octagonal wall member. A second pair of side walls 17 and 18 of the octagonal wall member are spaced oppositely of the intermediate strut wall 12 laterally from opposite sides of the intermediate strut wall preferably about equi-distantly, and the second pair of side walls 17 and 18 serve supplementally as strut walls of the gland 10. Third and fourth pairs of side walls of the octagonal wall member 11, respectively designated 19 and 20 and 21 and 22 in FIG. 1 interconnect opposite lateral ends of the first pair of side walls 13 and 14 of the octagonal wall member and opposite lateral ends of the second pair of side walls 17 and 18 of the octagonal wall member. The third and fourth pairs of side walls 19, 20, 21 and 22 are at about equal obtuse angles to the first pair of side walls 13 and 14 and also are at about equal obtuse angles to the second pair of side walls 17 and 18. Octagonal wall member 11 is approximately equilateral, being somewhat more elongated though in the direction from side wall 17 to side wall 18.

Side end and slanted connecting structure of gland 10 affords a pair of outer strut walls 23 and 24 at opposite lateral ends of the gland, and first and second pairs of slanted intermediate connecting walls respectively designated 25 and 26 and 27 and 28 in FIG. 1. Opposite lateral ends of side wall 17 in the second pair of side walls of the octagonal wall member 11, and opposite lateral ends of the outer strut wall 23 of the gland, are interconnected by the slanted intermediate connecting walls 25 and 26 which diverge outwardly from one another progressively from the octagonal wall member 11 and define a generally trapezoidal passageway 33 longitudinally through gland 10 with the side wall 17 and the outer strut wall 23. Similarly, opposite lateral ends of side wall 18 of the octagonal wall member 11, and opposite lateral ends of the outer strut wall 24 of the gland, are interconnected by the slanted intermediate connecting walls 27 and 28 which diverge outwardly from one another progressively from the octagonal wall member 11 and define a generally trapezoidal passageway 34 longitudinally through the gland with side wall 18 and the outer strut wall 24. The slanted intermediate connecting walls 25, 26, 27 and 28 have about the same lateral reach.

In the installation according to FIG. 1, wherein the gland 10 is included, a pair of relatively movable bodies 41 and 42 are for example sections of a concrete pavement and separated from one another by a movement tolerance space 47. A mount 40, such as an alloy metal extrusion product, is situated on the body 41 as a component thereof and is provided having flanges 43 and 45 and a web 44 interconnecting the latter two flanges thus producing a shallow channel configuration opening into the movement tolerance space 47 while the outer face of flange 43 is flush with the outer face of body 41. An anchor flange 46 constituting a rearward extention of the channel flange 45 extends rearwardly of the channel web 44 and is embedded in the body 41 for holding the mount 40 in position. Mount 40', being in all respects similar to mount 40, is similarly situated on the body 42 and anchored to that body for the shallow channels of mounts 40 and 40' to open toward one another across the movement tolerance space. The outer strut walls 23 and 24 at the opposite lateral ends of gland 10 are disposed within the shallow channels of mounts 40 and 40' and abut the webs of those channels inside the channels so as to have gland 10 extend across the movement tolerance space 47. Gland 10 may be held in place against the mounts 40 and 40' by reactive thrust of the gland, though preferably further with the aid of supplemental means, such as an adhesive applied between the outer strut walls 23 and 24 of the gland and the inside faces of the channels of mounts 40 and 40'.

It will also be seen from FIG. 1 that side wall 13 in the first pair of side walls of the octagonal wall member 11 is facially exposed to the outside, frontally of the gland 10, thereby being available as a land. The land is flanked at opposite lateral ends by valleys 29 and 30 produced by the third pair of side walls 19 and 20 of the octagonal wall member 11 in conjunction with the slanted intermediate connecting walls 26 and 27 of the gland. At the rearward face of the gland, the fourth pair of side walls 21 and 22 of the octagonal wall member and the slanted intermediate connecting walls 25 and 28 produce flutes which are inversions of the aforementioned valleys in gland 10, and the flutes open backwardly from the gland. The four angles produced laterally by the valleys and flutes, aforementioned with reference to gland 10, preferably are about equal to one another. Also, in the present embodiment, the faces of sides 13 and 14 of the octagonal wall member 11 and the opposite lateral ends of the outer strut walls 23 and 24 can lie approximately in two parallel planes when the gland 10 is relaxed. Gland 10 further is approximately symmetrical bi-laterally from the intermediate strut wall 12 to and including the outer strut walls 23 and 24.

It is worthy of note that gland 10, as viewed in the approximately fully relaxed condition in FIG. 1, presents an I-beam aspect which is developed by the intermediate strut wall 12 inside the octagonal wall member 11 in conjunction with the first pair of side walls 13 and 14 of the octagonal wall member. Further, the octagonal wall member 11 is supported inside the movement tolerance space 47 by means of the slanted intermediate connecting walls 25, 26, 27 and 28. When the relatively movable bodies 41 and 42 begin to reduce the width of the movement tolerance space 47, thrust is applied to the outer strut walls 23 and 24 and this thrust is transmitted by the slanted intermediate connecting walls 25, 26, 27 and 28, causing the second pair of side walls 17 and 18 of the octagonal wall member 11 to advance toward the intermediate strut wall 12 of the gland. The third and fourth pairs of side walls 19, 20, 21 and 22 of the octagonal wall member begin to flex about the opposite lateral ends of the first pair of side walls 13 and 14 of the octagonal wall member and move toward the intermediate strut wall 12, which accordingly is placed in tension, thereby affording resistance against the gland being distended outwardly in the immediate locations where the first pair of side walls 13 and 14 of the octagonal wall member 11 are connected with the intermediate strut wall 12.

As the second pair of side walls 17 and 18 of the octagonal wall member continue to advance toward the intermediate strut wall 12, the third and fourth pairs of side walls 19, 20, 21 and 22 of the octagonal wall member 11 continue to fold or flex and are brought into contact with the intermediate strut wall 12, and so are the side walls 17 and 18 in the second pair in the octagonal wall member 11. During these movements, the I-beam aspect provided by the intermediate strut wall 12 in conjunction with the first pair of side walls 13 and 14 remains appreciable and continues to do so at the compression end of the compression and relaxation range of gland 10. By the time that the latter condition has been reached, the outer strut walls 23 and 24 also have moved to be against the second pair of side walls 17 and 18 of the octagonal wall member 11, and the gland 10 has become quite dense, as will be appreciated from FIG. 3 which represents the gland as being about in fully compressed condition. The gland 10, accordingly, offers a considerably long compression and relaxation range while operating such as between the mounts 40 and 40' which carry the gland.

Turning to the embodiment according to FIG. 3, an elastomeric gland 10', whioh is similar in structure and folding and unfolding action to that of the gland in FIG. 1, is characterized by additionally having loop walls 50 and 51 at the rear of the gland further to render the gland self-bracing. Loop walls 50 and 51 interconnect opposite lateral ends of a rear side wall 14' in a first pair of side walls 13' and 14' of the octagonal wall member 11' with opposite lateral back ends of outer strut walls 23' and 24' of the gland 10'.

In the particular embodiment in FIG. 3, the loop wall structures 50 and 51 define generally pentagonal longitudinal passageways 52 and 53 through gland 10' with side walls 21' and 22' of the octagonal wall member 11' and slanted intermediate connecting walls 25' and 28', allowing the gland to be compressed and relaxed from side to side and the loop wall structures 50 and 51 to adjust by folding and unfolding. Having the intermediate strut wall 12' as a reference for symmetry, the gland 10' bi-laterally is about symmetrical throughout.

In the gland installation, also represented in FIG. 3, the gland 10' has faces of the outer strut walls 23' and 24' secured directly as by means of an adhesive to the relatively movable bodies 41' and 42', while the gland is situated inside the movement tolerance space 47' defined by the bodies 41' and 42', and gland 10' is adjacent to the front faces of those bodies, thus to co-act with those bodies. The gland as represented in FIG. 3 is about fully relaxed to facilitate an understanding of the configuration of the gland in that condition. Ordinarily, as initially installed, the gland would likely be partially compressed to allow for both a possible increase or decrease in width of the movement tolerance space 47'.

The present invention is, of course, in no way restricted to the specific disclosure of the specification and drawings herein, but also encompasses any modifications within the scope of the appended claims.

I claim:

1. An elastomeric gland for use inside a movement tolerance space between relatively movable bodies, said gland comprising: a generally octagonal wall member tubular longitudinally of said gland and an intermediate strut wall interconnecting a first pair of side walls of said octagonal wall member medially of said first pair of side walls inside said octagonal wall member thereby producing an I-beam aspect with said first pair of side walls prior to said octagonal wall member being compressed, a second pair of side walls of said octagonal wall member being spaced oppositely of said intermediate strut wall from opposite sides of said intermediate strut wall, and opposite lateral ends of said first and second pairs of side wall of said octagonal wall member being interconnected by third and fourth pairs of side walls of said octagonal wall member; and side end and slanted connecting structure including, opposite side end means to be against said relatively movable bodies when said gland is inside said movement tolerance space, and two pairs of slanted intermediate connecting walls interconnecting said second pair of side walls of said octagonal wall member and said opposite side end means, and said slanted intermediate connecting walls being spaced outwardly apart from one another in said pairs a progressively increased distance leading from said octagonal wall member, for supporting said octagonal wall member and transmitting thrust to move said second pair of side walls of said octagonal wall member toward said intermediate strut wall having said third and fourth pairs of side walls of said octagonal wall member flex reaching from said opposite lateral ends of said first pair of side walls of said octagonal wall member and ultimately, when said octagonal wall member is fully compressed, be in contact with said intermediate strut wall along with said second pair of side walls of said octagonal wall member, with said intermediate strut walls and said first pair of side walls of said octagonal wall member still appreciably preserving said I-beam aspect.

2. An elastomeric gland as set forth in claim 1, wherein said slanted intermediate connecting walls lead laterally from said octagonal wall member to about the same extent as one another and form angles of about the same magnitude with said second pair of side walls of said octagonal wall member.

3. An elastomeric gland as set forth in claim 1, wherein said slanted intermediate connecting walls lead laterally from said octagonal wall member to about the same extent as one another and form angles of about the same magnitude with said second pair of side walls of said octagonal wall member, and there are two longitudinal passageways through said gland formed by said side end and slanted connecting structure of said gland and said second pair of side walls of said octagonal wall member, having the faces of said gland inside each of said passageways define a generally trapezoidal configuration.

4. An elastomeric gland as set forth in claim 1, wherein said slanted intermediate connecting walls are connected to said opposite lateral ends of said second pair of side walls of said octagonal wall member.

5. An elastomeric gland as set forth in claim 1, wherein said slanted intermediate connecting walls are connected to said opposite lateral ends of said second pair of side walls of said octagonal wall member, lead laterally from said octagonal wall member to about the same extent as one another and form angles of about the same magnitude with said second pair of side walls of said octagonal wall member.

6. An elastomeric gland as set forth in claim 5, wherein there are two longitudinal passageways through said gland formed by said side end and slanted connecting structure of said gland and said second pair of side walls of said octagonal wall member, having the faces of said gland inside each of said passageways define a generally trapezoidal configuration.

7. An elastomeric gland as set forth in claim 1, wherein said gland bi-laterally is approximately symmetrical in structure to and including said side end and slanted connecting structure, having said intermediate strut wall as a reference for symmetry.

8. An elastomeric gland as set forth in claim 1, wherein loop wall structure at the back of said gland connects said opposite lateral ends of a rearward one of said first pair of side walls of said octagonal wall member with rearward lateral ends of said opposite side end means of said gland and said gland is hollow internally next to said loop wall structure.

9. An elastomeric gland for use inside a movement tolerance space between relatively movable bodies, said gland comprising: a generally octagonal wall member tubular longitudinally of said gland and an intermediate strut wall interconnecting a first pair of side walls of said octagonal wall member medially of said first pair of side walls inside said octagonal wall member thus producing an I-beam aspect with said first pair of side walls prior to said octagonal wall member being compressed, a second pair of side walls of said octagonal wall member being spaced oppositely of said intermediate strut wall from opposite sides of said intermediate strut wall, and opposite lateral ends of said first and second pairs of side walls of said octagonal wall member being interconnected by third and fourth pairs of side walls of said octagonal wall member; and side end and slanted connecting structure defining two longitudinal passageways through said gland with said second pair of side walls of said octagonal wall member and comprising, a pair of outer strut walls to be against said relatively movable bodies when said gland is inside said movement tolerance space, and two pairs of slanted intermediate connecting walls connecting opposite lateral ends of said pair of outer strut walls with opposite lateral ends of said second pair of side walls of said octagonal wall member, and said two pairs of slanted intermediate connecting walls being spaced outwardly apart from one another in said pairs a progressively increased amount leading from said octagonal wall member, for supporting said octagonal wall member and transmitting thrust to move said second pair of side walls of said octagonal wall member toward said intermediate strut wall having said third and fourth pairs of side walls of said octagonal wall member flex reaching from said opposite lateral ends of said first pair of side walls of said octagonal wall member and ultimately, when said octagonal wall member is fully compressed, be in contact with said intermediate strut wall along with said second pair of side walls of said octagonal wall member while said outer strut walls are in contact with said second pair of side walls of said octagonal wall member, with said intermediate strut wall and said first pair of side walls of said octagonal wall member still appreciably preserving said I-beam aspect.

10. An elastomeric gland as set forth in claim 9, wherein said slanted intermediate connecting walls lead laterally from said opposite lateral ends of said second pair of side walls of said octagonal wall member to about the same extent as one another and form angles of about the same magnitude with said second pair of side walls of said octagonal wall member.

11. An elastomeric gland as set forth in claim 10, wherein said gland facially inside each of said longitudinal passageways defines a generally trapezoidal configuration.

12. An elastomeric gland as set forth in claim 9, wherein said gland longitudinally is hollow internally next to loop wall structure at the back of said gland, having said loop wall structure connect said opposite lateral ends of a rearward one of said first pair of side walls of said octagonal wall member with rearward ones of said opposite lateral ends of said outer pair of strut walls.

13. An elastomeric gland as set forth in claim 9, wherein said gland longitudinally is hollow internally generally pentagonally next to loop wall structure at the back of said gland, having said loop wall structure connect said opposite lateral ends of a rearward one of said first pair of side walls of said octagonal wall member with rearward ones of said opposite lateral ends of said outer pair of strut walls.

14. An elastomeric gland as set forth in claim 9, wherein said intermediate strut wall and said octagonal wall member define a pair of generally hexagonal passageways longitudinally through said gland.

15. An elastomeric gland as set forth in claim 14, wherein said gland is approximately symmetrical in structure bi-laterally from said intermediate strut wall and said slanted intermediate connecting walls form approximately equal angles with said third and fourth pairs of side walls of said octagonal wall member.

16. An elastomeric gland as set forth in claim 15, wherein said two longitudinal passageways defined through said gland by side end and slanted connecting structure with said second pair of side walls of said octagonal wall member have generally trapezoidal boundaries.

17. An elastomeric gland as set forth in claim 16, wherein said gland longitudinally is hollow interiorily next to loop wall structure at the back of said gland, having said loop wall structure connect said opposite lateral ends of a rearward one of said first pair of side walls of said octagonal wall member with rearward ones of said opposite lateral ends of said outer pair of strut walls.

18. An elastomeric gland as set forth in claim 9, wherein said I-beam of said gland and said outer pair of strut walls are of about the same lateral extent from front toward the rear of said gland.

* * * * *